US005268019A

United States Patent [19]

Rathbone

[11] Patent Number: 5,268,019

[45] Date of Patent: Dec. 7, 1993

[54] AIR SEPARATION METHOD AND APPARATUS COMBINED WITH A BLAST FURNACE

[75] Inventor: Thomas Rathbone, Farnham, United Kingdom

[73] Assignee: The BOC Group plc, Windlesham, Surrey, England

[21] Appl. No.: 848,797

[22] Filed: Mar. 10, 1992

[30] Foreign Application Priority Data

Mar. 11, 1991 [GB] United Kingdom ..... 9105109.4

[51] Int. Cl.[5] ..... C21B 5/06

[52] U.S. Cl. ..... 75/466; 60/39.12; 75/958; 266/155; 266/160; 266/197

[58] Field of Search ..... 75/433, 466, 958; 266/155, 157, 160, 197; 60/39.02, 39.12

[56] References Cited

U.S. PATENT DOCUMENTS

| | | | |
|---|---|---|---|
| 3,304,074 | 2/1967 | Atherton | 75/466 |
| 4,557,735 | 12/1985 | Pike | 55/26 |
| 4,861,369 | 8/1989 | von Bogdandy et al. | 266/160 |
| 4,962,646 | 10/1990 | Rathbone | 62/24 |
| 5,076,837 | 12/1991 | Rathbone et al. | 75/433 |

FOREIGN PATENT DOCUMENTS

| | | |
|---|---|---|
| 269609 | 1/1988 | European Pat. Off. . |
| 282321 | 9/1988 | European Pat. Off. . |
| 367428 | 5/1990 | European Pat. Off. . |
| 3908505 | 9/1989 | Fed. Rep. of Germany . |

*Primary Examiner*—Melvyn J. Andrews
*Attorney, Agent, or Firm*—David M. Rosenblum; Larry R. Cassett

[57] ABSTRACT

Air is taken from the air compressor of a gas turbine including in addition to the compressor a combustion chamber and an expansion turbine. The gas turbine drives an alternator. The air taken from the compressor is cooled in heat exchanger to remove heat of compression therefrom. The air is separated in an air separation plant into oxygen and nitrogen. A stream of oxygen is withdrawn from the plant and used in a blast furnace in which iron is made. The off-gas from the blast furnace is a low grade gaseous fuel. It is compressed in compressor which has interstage cooling to remove at least some of the heat of compression. The compressed fuel gas is passed through the heat exchanger countercurrently to the air stream. The resulting pre-heated fuel gas flows into the combustion chamber of the gas turbine and is burned therein to generate gaseous combustion products that are expanded in the turbine. A nitrogen stream is withdrawn in the air separation plant. A part of the nitrogen stream is introduced into the combustion chamber and is expanded with the aforesaid gaseous combustion products, while another part is expanded in a separate expansion turbine.

19 Claims, 3 Drawing Sheets

AIR SEPARATION METHOD AND APPARATUS COMBINED WITH A BLAST FURNACE

BACKGROUND OF THE INVENTION

This invention relates to air separation in general, and in particular to a method of generating power including an air separation step.

It is known to be advantageous in certain circumstances to recover work from nitrogen produced in a cryogenic air separation plant. One such circumstance is when there is a large local demand for oxygen but no complementary demand for nitrogen. In some proposals for so recovering work, the nitrogen is compressed and then passed to a gas turbine comprising a compressor for compressing air, a combustion chamber which uses the air compressor to support combustion of a fuel and an expansion turbine which expands the combustion gases. To this end, the nitrogen may be passed directly into the expansion turbine or into a region upstream of the expansion turbine. The expansion turbine is arranged to perform external work by driving the air compressor and an alternator to enable electricity to be generated. By this means most if not all of the energy requirements of the air separation can be met. Examples of such methods are included in U.S. Pat. Nos. 2,520,862 and 3,771,495.

The fuel used in the gas turbine is normally one of high calorific value, i.e. above 10MJ/m$^3$. In some industrial processes in which oxygen is used, a low calorific value gas is generated and it is desirable to make use of this gas.

It has also been proposed in our European patent application EP-A-402 045 to recover work from nitrogen by heat exchanging it at elevated pressure with a hot gas stream and then expanding the resulting warmed nitrogen with the performance of external work. Such proposals do not however involve the combustion of a low calorific value gas stream.

SUMMARY OF THE INVENTION

It is an aim of the present invention to provide a method and apparatus for generating power from first a low grade fuel gas formed by a reaction or reactions in which the oxygen product of air separation takes part and second a nitrogen product of the air separation.

According to the present invention there is provided a method of generating power, comprising:

a) compressing air without removing at least part of the heat of compression thereby generated;
b) dividing the compressed air flow into a major stream and a minor stream;
c) separating the minor air stream into oxygen and nitrogen;
d) supplying a stream of oxygen separated from the air to take part in a chemical reaction or reactions that produce a low grade gaseous fuel stream;
e) compressing the low grade fuel stream;
f) pre-heating the fuel stream by heat exchange with the minor air stream and thereby cooling said minor air stream upstream of its separation;
g) burning said pre-heated fuel stream utilising said major air stream to support its combustion;
h) expanding with the performance of external work the combustion gases from the burning of said fuel stream, the work performed comprising the generation of said power; and i) expanding a stream of said nitrogen with the performance of external work.

The invention also provides plant for generating power, comprising a gas turbine comprising an air compressor for feeding to a combustion chamber a major air stream formed of compressed air from which at least part of the heat of compression has not been removed, and a turbine for expanding gases leaving the combustion chamber and for driving the compressor; means for separating a minor stream of air taken from said compressor into an oxygen stream and a nitrogen stream; a reactor for conducting a reaction or reactions in which oxygen partakes to form a low grade gaseous fuel stream; a compressor for compressing the gaseous fuel stream; a heat exchanger for pre-heating the compressed gaseous fuel stream by heat exchange with said minor stream of air taken from said air compressor for separation, said heat exchanger having a first outlet communicating with the combustion chamber and a second outlet communicating with the air separation means; means for expanding said stream of nitrogen with the performance of external work and power generation means adapted to be driven by said turbine.

By the term "low grade fuel", as used herein, is meant a fuel having a calorific value of less than 10 MJ/m$^3$.

The method and plant according to the invention find particular use when the source of the low grade gaseous fuel stream is a blast furnace.

There is an increasing trend in the iron and steel industry to operate blast furnaces with coal (in addition to coke) and with an air blast enriched in oxygen. The resulting gas mixture comprises nitrogen, carbon monoxide, carbon dioxide, and hydrogen. The precise composition of this gas depends on a number of factors including the degree of oxygen enrichment. Typically, however, it has a calorific value in the range of 3 to 5 MJ/m$^3$.

The low grade fuel gas stream typically exits the blast furnace or other reactor at elevated temperature, laden with particulate contaminants, and including undesirable gaseous constituents such as hydrogen cyanide, carbon oxysulphide, and hydrogen sulphide. Processes and apparatuses whereby the gas can be cooled to approximately ambient temperature, have particulates removed therefrom, are well known. The low grade fuel gas is preferably subjected to such a treatment upstream of the fuel gas compressor.

The compressor typically raises the pressure of the gaseous fuel stream to a pressure in the range of 10 to 25 atmospheres absolute, the precise pressure depending on the operating pressure of the combustion chamber in which combustion of the fuel gas takes place.

The pre-heating of the fuel gas stream may raise its temperature to a value in the range 350° to 400° C., or a lower temperature may be employed.

The expansion of the nitrogen may be achieved by introducing a stream of said nitrogen into said combustion gases. The nitrogen is thus expanded in the expander of the gas turbine.

The air is preferably separated by being rectified. The stream of nitrogen to be introduced into the combustion gases is preferably pre-compressed to a pressure a little in excess of that of the combustion chamber in which combustion of the fuel gas takes place. It is then preferably pre-heated to a temperature up to 600° C. by heat exchange with a suitable fluid. The fluid may, for example, be a stream taken from the gas mixture leaving the turbine. Alternatively, it may be any other available hot gas stream preferably having a temperature under 600° C.

The pre-heated nitrogen stream is preferably introduced into the combustion chamber in which combustion of the fuel gas takes place. Alternatively, it can be introduced into the mixture of gaseous combustion products intermediate the combustion chamber and the expansion turbine or directly into the expansion turbine itself.

The nitrogen compressor preferably has no aftercooler associated therewith for removing the heat of compression from the nitrogen, although interstage cooling is used in order to keep down the power consumption.

The rectification of the air is preferably performed in a double column comprising a lower pressure stage and a higher pressure stage. There is preferably a condenser-reboiler associated with the two said stages of the double column so as to provide reboil for the lower pressure stage and reflux for both stages. The lower pressure stage preferably has an operating pressure (at its top) in the range of 3 to 6 atmospheres absolute. Operation of the lower pressure column in this range makes possible more efficient separation of the air than that possible at the more conventional operating pressures in the range of 1 to 2 atmospheres absolute. Moreover, the size of the pressure range over which the nitrogen is compressed is reduced. Typically, the pressure at which the higher pressure stage operates is a little below the outlet pressure of the air compressor of the gas turbine. It is to be appreciated that if there is a condenser-reboiler linking the two stages of the rectification column, the operating pressure of the lower pressure stage depends on that of the higher pressure stage, places a limitation on the pressure at which the lower pressure stage can be operated.

The rate at which nitrogen is taken for expansion in the gas turbine is determined by the operating characteristics of the turbine. Typically, the gas turbine is designed for a given flow rate of air. By taking some of the compressed air for separation into oxygen and nitrogen, it becomes possible to replace this air with nitrogen. Such replacement of air with nitrogen tends to reduce the concentration of oxides of nitrogen in the gas mixture leaving the turbine.

Typically, particularly when the fuel gas is produced by a blast furnace, the rate at which nitrogen can be expanded with the combustion gases in the turbine is substantially less than the rate at which nitrogen is produced, this rate being dependent on the demand for oxygen of the blast furnace. If desired, some or all of the excess nitrogen may be taken as a product for another use. If, however, there is no such other demand for the excess nitrogen, it too is preferably used in the generation of electricity. Accordingly, a second stream of the nitrogen product of the air separation is preferably heat exchanged at elevated pressure with another fluid stream and then expanded with the performance of external work in a second turbine independent of the gas turbine. The nitrogen is preferably expanded without being mixed with other fluid. The additional expander is preferably used to drive an alternator so as to generate electrical power. The heat exchange fluid with which the second stream of nitrogen is heat exchanged may be a stream of exhaust gases from the gas turbine or may be any other hot fluid that is available. The second stream of nitrogen is preferably taken for expansion at a pressure in the range of 2 to 6 atmospheres absolute. It is preferably pre-heated to a temperature in the range of 200° to 600° C. Preferably the second stream of nitrogen is taken from upstream of the said nitrogen compressor. If the nitrogen is separated from the air in a rectification column comprising higher and lower pressure stages, the latter operating at a pressure in the range of 3 to 6 atmospheres, the second nitrogen stream is preferably taken at this pressure and not subjected to any further compression.

If desired, the oxygen product may be compressed upstream of the blast furnace or other reactor in which it is used.

Operation of the compressor for the fuel gas with removal of the heat of compression makes possible a significant increase in its attainable compression efficiency, and thus the method according to the invention makes possible relatively efficient generation of power from a low grade fuel gas stream and from the nitrogen by-product of the air separation process.

BRIEF DESCRIPTION OF THE DRAWINGS

The method and plant according to the invention will now be described by way of example with reference to the accompanying drawings, in which.

DETAILED DESCRIPTION

Figure 1:
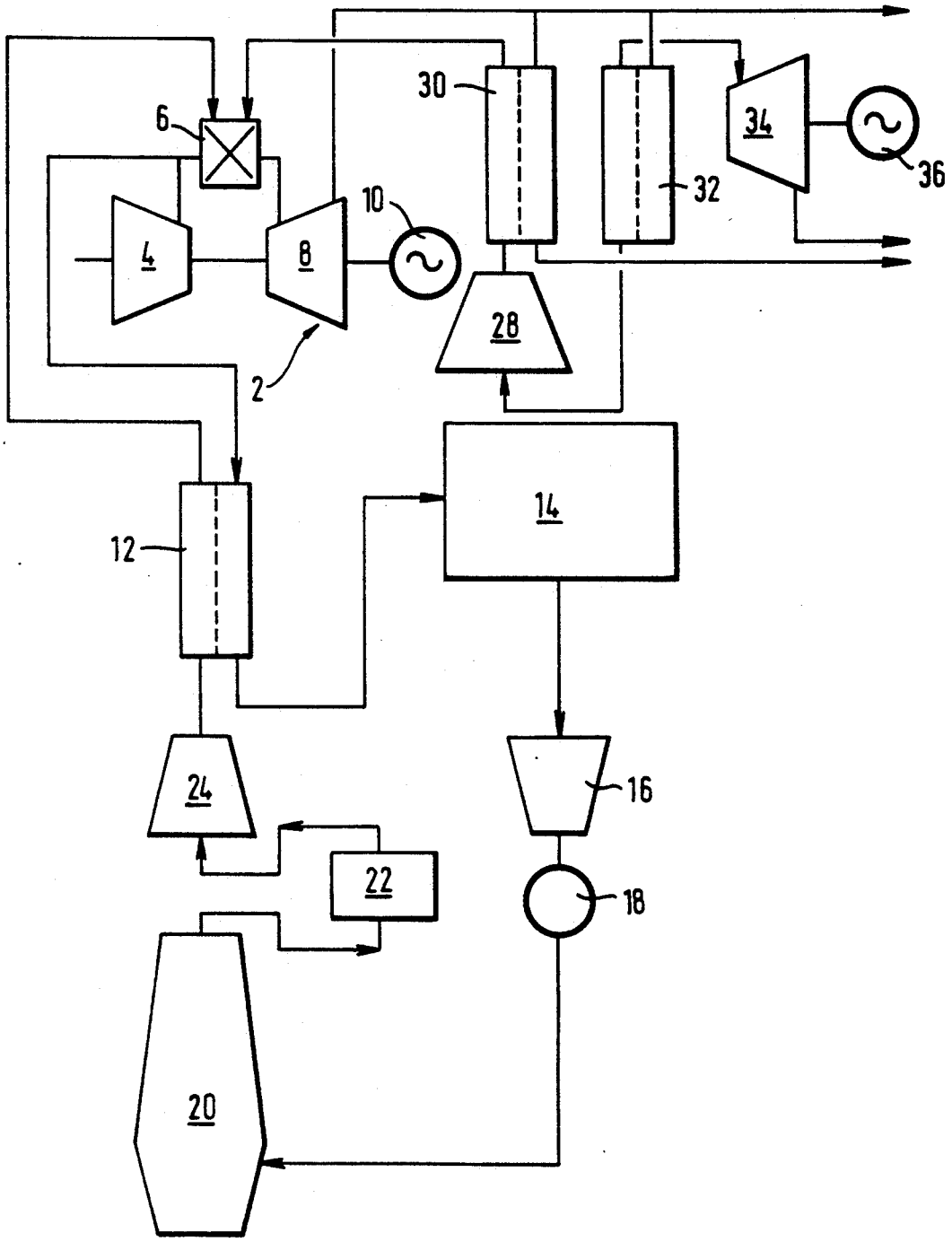
FIG. 1 is a flow diagram illustrating a first power generation cycle according to the invention.

Referring to FIG. 1 of the drawings, the illustrated plant includes a gas turbine 2 comprising an air compressor 4, a combustion chamber 6 and an expansion turbine 8. The rotor (not shown) of the air compressor 4 is mounted on the same shaft as the rotor (not shown) of the turbine 8 and thus the turbine 8 is able to drive the compressor 4. The compressor 4 draws in a flow of air and compresses it to a chosen pressure in the range of 10 to 20 atmospheres absolute. The compressor 4 has no means associated therewith for removing the resultant heat of compression. The compressed air leaving the compressor 4 is divided into a major stream and a minor stream. Typically, the major stream comprises from 65 to 90% of the total air flow. The major stream is supplied to the combustion chamber 6. It is employed to support combustion of a fuel gas also supplied to the combustion chamber 6. The resulting hot stream of combustion gases flows into the expansion turbine 8 and is expanded to a pressure a little above atmospheric pressure therein. The expansion turbine 8 as well as driving the compressor 4 also drives an alternator 10 which produces electrical power.

The minor stream of compressed air, flows through a heat exchanger 12 in which it is cooled to approximately ambient temperature by countercurrent heat exchange with the stream of fuel gas that is supplied to the combustion chamber 6 of the gas turbine 2. The heat of compression in the minor air stream is typically sufficient to raise the temperature of the fuel gas from about ambient temperature to a value in the range of 350° to 400° C. The resulting cooled air stream passes from the heat exchanger 12 to a plant 14 for separating air by rectification. A stream of oxygen product and a stream of nitrogen product are withdrawn from the plant 14. The stream of oxygen product is compressed to a pressure of about 8 bar absolute in an oxygen compressor 16 having an after cooler 18 associated therewith for removing heat of compression from the oxygen. The compressed oxygen stream is used to enrich in oxygen an air blast which is supplied to a blast furnace 20.

The blast furnace 20 is used to reduce iron ore to make iron or steel by reaction with solid carbonaceous fuel. The necessary heat for the reaction is generated by the reaction of the oxygen-enriched air with the carbonaceous fuel. A resultant gas mixture comprising carbon monoxide, hydrogen, carbon dioxide, nitrogen and argon is produced. It typically has a calorific value in the order of 3 to 5 $MJ/m^3$ depending on the composition of the oxygen-enriched air. The gas mixture leaving the top of the blast furnace will also contain traces of oxides of sulphur and nitrogen, be laden with particulate contaminants, and be at elevated temperature. The gas mixture is treated in a plant 22 of conventional kind to cool it to ambient temperature, and to remove undesirable gaseous impurities and particulate contaminants.

The purified fuel gas stream from the plant 22 is then compressed in a compressor 24. The fuel gas is raised in pressure to a value a little above the operating pressure of the combustion chamber 6. The compressed fuel gas stream then passes through the heat exchanger 12 to the combustion chamber 6 as described above.

The stream of nitrogen taken from the air separation plant 14 is divided into first and second streams, typically of about equal size. The first subsidiary stream of nitrogen is compressed in a compressor 28 to a pressure a little above that at which the combustion chamber 6 operates. The nitrogen is then heated to a temperature of about 500° C. in a heat exchanger 30 by countercurrent heat exchange with a stream of exhaust gas taken from the turbine 8. The exhaust gas leaving the heat exchanger 30 may be passed to a stack (not shown) and vented to the atmosphere. The pre-heated nitrogen leaving the heat exchanger 30 passes into the combustion chamber 6 and thus becomes mixed with the combustion gases and is expanded therewith in the turbine 8.

The second stream of nitrogen is taken from upstream of the compressor 28 (preferably at a pressure in the range of 3 to 6 atmospheres) and is pre-heated to a temperature of about 400° C. by passage through a heat exchanger 32. The pre-heating is effected by countercurrent heat exchange with another stream of exhaust gas from the turbine 8. The resulting pre-heated second stream of nitrogen flows to an expansion turbine 34 in which it is expanded to approximately atmospheric pressure without being mixed with any other fluid stream. The exhaust gases from the turbine 34 are passed to the stack. The turbine 34 is employed to drive an alternator 36 and thereby generates electrical power.

Typically, not all the exhaust gas from the turbine 8 are passed through the heat exchangers 30 and 32. The excess exhaust gas may be passed to a waste heat boiler (not shown) to recover the heat therefrom by raising steam. Alternatively, exhaust gas from the turbine 8 may be used to pre-heat the air blast of the blast furnace 20.

Figure 2:
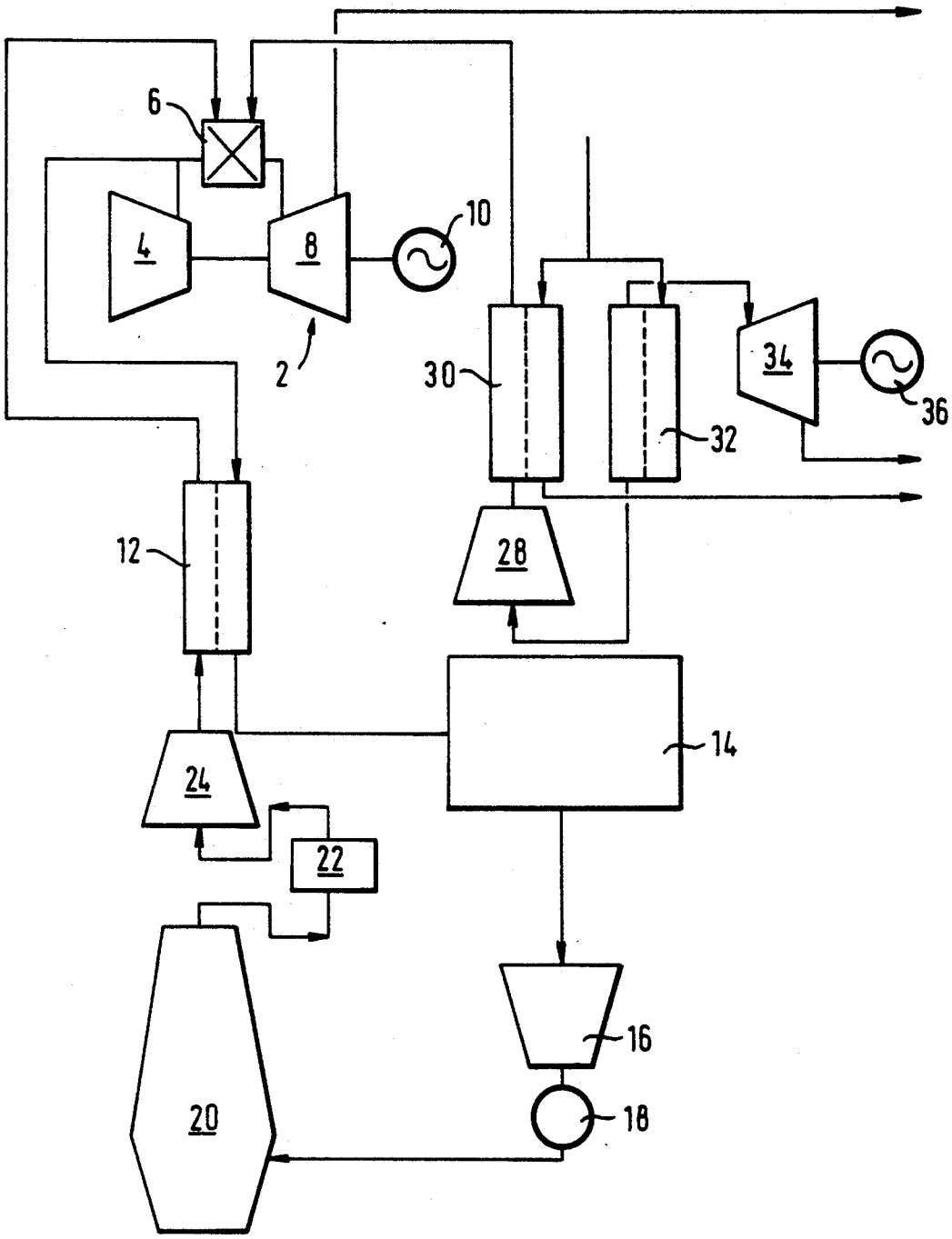
FIG. 2 is a flow diagram illustrating a second power generation cycle according to the invention.

The plant shown in FIG. 2 is generally similar to that shown in FIG. 1. Like parts shown in the two Figures are indicated by the same reference numerals. These parts and their operation will not be described again with reference to FIG. 2.

Referring to FIG. 2, there is one main different between the plant illustrated therein and that illustrated in FIG. 1. This difference is that all the exhaust gas from the turbine 8 is passed to a waste heat boiler. A heat transfer fluid from any available source is used to preheat the nitrogen streams in the heat exchangers 30 and 32.

Figure 3:
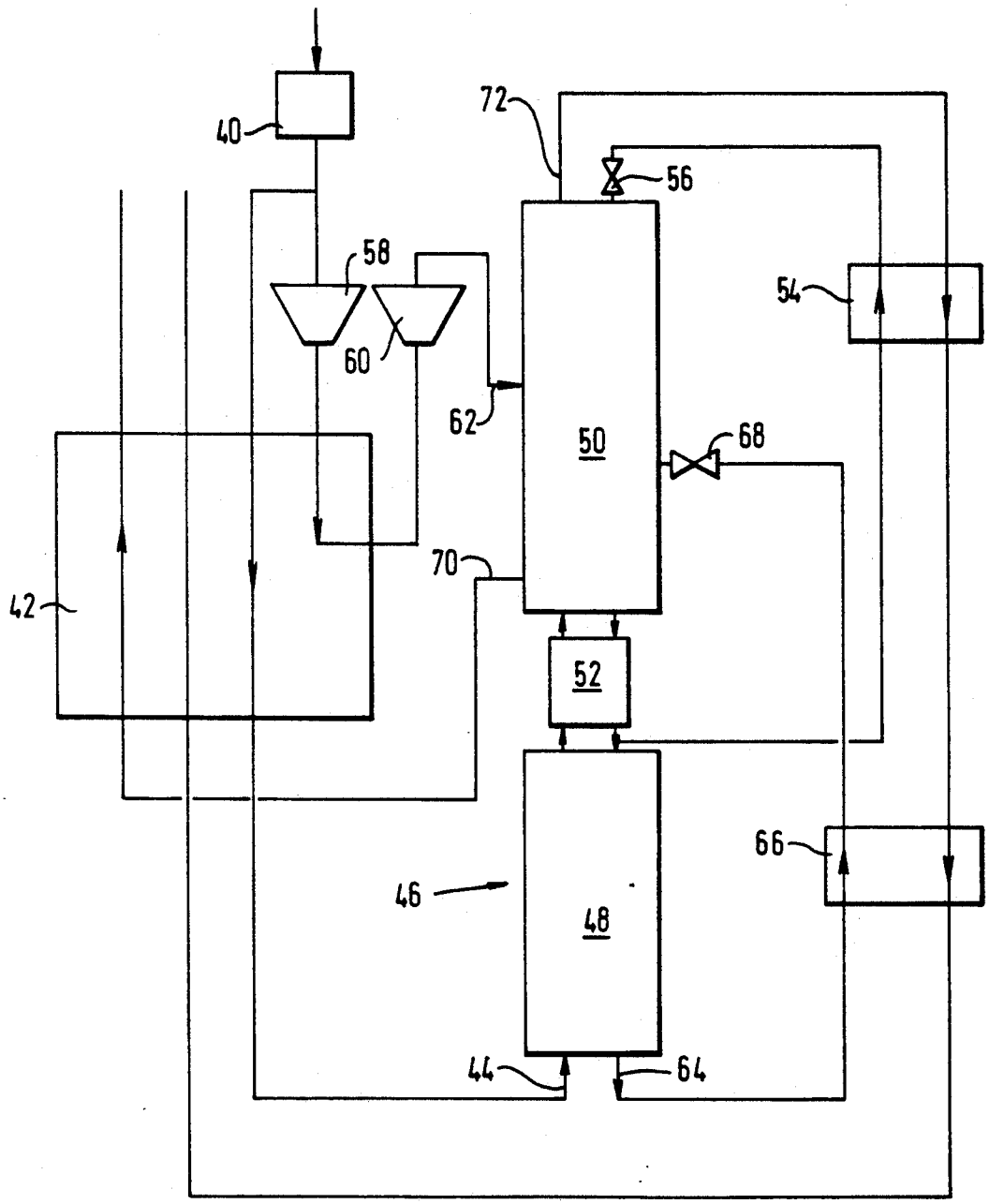
FIG. 3 is a flow diagram illustrating an air separation process for use in the cycles shown in FIGS. 1 and 2.

Referring now to FIG. 3 of the drawings, there is shown an air separation plant for use as the plant 14 in FIGS. 1 and 2.

An air stream is passed through a purification apparatus 40 effective to remove water vapour and carbon dioxide from the compressed air. The apparatus 40 is of the kind which employs beds of adsorbent to adsorb water vapour and carbon dioxide from the incoming air. The beds may be operated out of sequence with one another such that while one or more beds are being used to purify air, the others are being regenerated, typically by means of a stream of nitrogen. The purified air stream is divided into major and minor streams.

The major stream passes through a heat exchanger 42 in which its temperature is reduced to a level suitable for the separation of the air by rectification. Typically, therefore, the major air stream is cooled to its saturation temperature at the prevailing pressure. The major air stream is then introduced through an inlet 44 to a higher pressure stage 48 of a double rectification column having, in addition to the stage 48, a lower pressure stage 50. Both rectification stages 48 and 50 contain liquid-vapor contact trays (not shown) and associated downcomers (not shown) (or other means for effecting intimate contact between a descending liquid phase and an ascending vapour phase) whereby a descending liquid phase is brought into intimate contact with an ascending vapour phase such that mass transfer occurs between the two phases. The descending liquid phase becomes progressively richer in oxygen and the ascending vapor phase progressively richer in nitrogen. The higher pressure rectification stage 48 operates at a pressure substantially the same as that to which the incoming air is compressed and separates the air into an oxygen-enriched air fraction and a nitrogen fraction. The lower pressure stage 50 is preferably operated so as to give substantially pure nitrogen fraction at its top but an oxygen fraction at its bottom which still contains an appreciable proportion of nitrogen (say, up to 5% by volume).

The stages 48 and 50 are linked by a condenser-reboiler 52. The condenser-reboiler 52 receives nitrogen vapor from the top of the higher pressure stage 48 and condenses it by heat exchange with boiling liquid oxygen in the stage 50. The resulting condensate is returned to the higher pressure stage 48. Part of the condensate provides reflux for the stage 48 while the remainder is collected, sub-cooled in a heat exchanger 54 and passed into the top of the lower pressure stage 50 through an expansion valve 56 and thereby provides reflux for the stage 50. The lower pressure rectification stage 50 operates at a pressure lower than that of the stage 48 and receives oxygen-nitrogen mixture for separation from two sources. The first source is the minor air stream formed by dividing the stream of air leaving the purification apparatus 40. Upstream of its introduction into the stage 50 the minor air stream is compressed in a compressor 58 having an after-cooler (not shown) associated therewith, is then cooled to a temperature of about 200K in the heat exchanger 42, is withdrawn from the heat exchanger 42 and is expanded in an expansion turbine 60 to the operating pressure of the stage 50, thereby providing refrigeration for the process. This air stream is then introduced into the lower pressure stage 50 through inlet 62. If desired, the expansion turbine 60 may be employed to drive the compressor 58, or alternatively the two machines, namely the compressor 58 and the turbine 60, may be independent of one another. If desired, the compressor 58 may be omitted, and the turbine 60 used to drive an electrical power generator (not shown).

The second source of oxygen-nitrogen mixture for separation in the lower pressure rectification stage 50 is a liquid stream of oxygen-enriched fraction taken from the bottom of the higher pressure stage 48. This stream is withdrawn through an outlet 64, is sub-cooled in a heat exchanger 66 and is then passed through a Joule-Thomson valve 68 and flows into the stage 50 at an intermediate level thereof.

The apparatus shown in FIG. 3 of the drawings produces a product oxygen stream and a product nitrogen stream. The product oxygen stream is withdrawn as vapor from the bottom of the lower pressure stage 50 through an outlet 70. This stream is then warmed to approximately ambient temperature in the heat exchanger 42 by countercurrent heat exchange with the incoming air. A nitrogen product stream is taken directly from the top of the lower pressure rectification stage 50 through an outlet 72. This nitrogen stream flows through the heat exchanger 54 countercurrently to the liquid nitrogen stream withdrawn from the higher pressure stage 48 and effects the sub-cooling of this stream. The nitrogen product stream then flows through the heat exchanger 66 countercurrently to the liquid stream of oxygen-enriched fraction and effects the sub-cooling of this liquid stream. The nitrogen stream flows next through the heat exchanger 42 countercurrently to the major air stream and is thus warmed to approximately ambient temperature.

In an example of the operation of the power generation cycle illustrated in FIG. 1, the minor stream of air from the compressor 4 of the gas turbine 2 enters the heat exchanger 12 at a flow rate of 160 kg/s, a temperature of 696K and a pressure of 15.0 bar. This air stream leaves the heat exchanger 12 at a temperature of 273K and a pressure of 14.5 bar. The resulting cooled air stream is then separated in the plant 14. A stream of oxygen is produced by the plant 14 at a flow rate of 34.7 kg/s, a temperature of 290K and a pressure of 5.3 bar. This stream is compressed in the compressor 16 and leaves the aftercooler 18 associated therewith at a temperature 300K and a pressure of 8 bar. The compressed oxygen stream then flows into the blast furnace 20.

The blast furnace 20 produces a calorific gas stream which after purification comprises 27.4% by volume of carbon monoxide 18.0% by volume of carbon dioxide, 2.8% by volume of hydrogen and 51.8% by volume of nitrogen (calorific value 3.85 $MJ/m^3$). This gas mixture is produced at a rate of 144.1 kg/s. It enters the compressor 24 at a pressure of 1 bar and a temperature of 293K, leaving the compressor 24 at a pressure of 20 bar and a temperature of 373K. This gas stream is then pre-heated in the heat exchanger 12 and enters the combustion chamber 6 of the gas turbine 2. The combustion chamber 6 also receives the major air stream from the compressor 4 at a flow rate of 355.9 kg/s a temperature of 696K and a pressure of 15 bar. The combustion chamber 6 further receives a stream of compressed nitrogen which is formed by taking 76.2 kg/s of nitrogen from the air separation plant 14 at a temperature of 290K and a pressure of 4.8 bar and compressing it in the compressor 28 to a pressure of about 20 atmospheres. The compressed nitrogen stream then flows through the heat exchanger 30 and leaves it at a temperature of 773K and a pressure of 20.0 bar. This nitrogen stream then flows into the combustion chamber 6. A mixture of nitrogen and combustion products from the chamber 6 flows at a rate of 560 kg/s, a temperature of 1493 K and a pressure of 15 bar into the expander 8 of the gas turbine 2 and leaves the expander 8 at a temperature of 823K and a pressure of 1.05 bar. A part of this stream is then used to provide cooling for the heat exchanger 30, while the remainder is used to provide cooling for a heat exchanger 32 in which a second stream of nitrogen from the air separation plant 14 is heated.

The second stream of nitrogen is taken at a rate of 49.4 kg/s and enters the heat exchanger 32 at a temperature of 290K and a pressure of 4.8 bar. It is heated in the heat exchanger 32 to a temperature of 773K and leaves the heat exchanger 32 at a pressure of 4.6 bar. It is then expanded in the expander 34 to a pressure of about 1.05 bar. The resulting expanded nitrogen together with the gas streams leaving the colder ends of the heat exchangers 30 and 32 are then vented to a stack.

When operated as described in the above example the gas turbine has an output of 166.7 MW and the nitrogen expander 34 an output of 19.1 MW. Taking into account the respective power consumptions of the compressors 16, 24 and 28 (respectively 1.8, 44.3 and 15.5 MW) there is a net power production of 124.2 MW. In addition, 36.0 MW can be credited to the air separation plant 14 so that the overall power input is 160.2 MW. The resultant efficiency of this power production is calculated to be 38.9%.

In addition, power can be generated by raising steam from a part of the gas leaving the expander 8 and then expanding the steam in a turbine output in the example described above, some 50.7 MW can be generated in this way. Accordingly, the total power output of the process becomes 210.9 MW which produces a calculated combined efficiency of 51.2%. This efficiency is higher than can be achieved with a high grade fuel such as natural gas.

In the above example, all pressures are absolute values.

I claim:

1. A method of generating power comprising the steps of:

a) compressing air to produce a compressed air flow without removing from the air at least part of a first heat of compression thereby generated;

b) dividing the compressed air flow into a major air stream and a minor air stream;

c) separating the minor air stream into oxygen and nitrogen;

d) supplying a stream of said oxygen to take part in a chemical reaction or reactions that produce a low grade gaseous fuel stream;

e) compressing the low grade gaseous fuel stream and thereby producing a second heat of compression;

f) removing at least part of the second heat of compression of the low grade gaseous fuel stream and then pre-heating the low grade gaseous fuel stream by heat exchange with the minor air stream and thereby cooling said minor air stream upstream of its separation;

g) burning said low grade gaseous fuel stream, after the pre-heating thereof, and utilising said major air stream to support its combustion;

h) expanding with the performance of external work combustion gases produced from the burning of said low grade gaseous fuel stream, the work performed comprising generation of said power; and i) expanding a stream of said nitrogen with the performance of external work.

2. The method as claimed in claim 1, in which the low grade gaseous fuel stream is supplied from a blast furnace.

3. The method as claimed in claim 1 or claim 2, in which the low grade gaseous fuel stream has a calorific value in the range of 3 to 5 MJ/m3.

4. The method as claimed in claim 1 or claim 2 in which the stream of nitrogen is introduced into said combustion gases and is expanded therewith.

5. The method as claimed in claim 4, in which the stream of nitrogen is compressed upstream of the introduction of the stream of nitrogen into said combustion gases.

6. The method as claimed in claim 5, in which the stream of the nitrogen is pre-heated to a temperature up to 600° C. by heat exchange with a fluid.

7. The method as claimed in claim 5, in which the fluid is a stream taken from the combustion gases after the expansion thereof.

8. The method as claimed in claim 1, in which a second stream of said nitrogen is heat exchanged at elevated pressure with a fluid stream and is then expanded with the performance of external work.

9. The method as claimed in claim 8, in which the second stream of said nitrogen is expanded without being mixed with other fluid.

10. The method as claimed in claim 8 or claim 9, in which the fluid stream with which the second stream of said nitrogen is heat exchanged is taken from the combustion gases after the expansion thereof.

11. The method as claimed in claim 8, in which the second stream of nitrogen is expanded from a pressure in the range of 2 to 6 atmospheres absolute and a temperature in the range of 200° to 600° C.

12. The method as claimed in claim 1, in which the air is separated by rectification in a double column comprising a lower pressure stage and a higher pressure stage, the lower pressure stage having a top and a bottom and an operating pressure at the top of the low pressure stage in a range of 3 to 6 atmospheres absolute.

13. A plant for generating power comprising:

a gas turbine having, an air compressor for forming a stream of compressed air having a heat of compression, dividing means for dividing the stream of compressed air into major and minor air streams, a combustion chamber communicating with the air compressor via the dividing means such that the major air stream feeds the combustion chamber and such that at least part of the heat of compression is not removed from the major air stream, and a turbine for expanding gases produced in the combustion chamber, the turbine connected to the air compressor such that the air compressor is driven by the turbine;

separation means communicating with the dividing means of the gas turbine for separating the minor air stream into oxygen and nitrogen and for producing an oxygen stream and a nitrogen stream;

a reactor communicating with the separating means for conducting a reaction in which the oxygen from the oxygen stream partakes to form a low grade gaseous fuel stream;

a fuel compressor communication with to the reactor for compressing the low grade gaseous fuel stream;

a heat exchanger connected intermediate the dividing means and the reactor and communicating with the gas compressor for preheating the low grade gaseous fuel stream with said minor air stream;

expansion means communicating with said separation means for expanding said nitrogen stream with the performance of external work;

and power generation means connected to said gas turbine for generating power.

14. The plant as claimed in claim 13, in which the reactor is a blast furnace.

15. The plant as claimed in claims 13 or 14, in which said separation means includes a double rectification column having high and low pressure stages.

16. The plant as claimed in claim 14, wherein said expansion means comprises said turbine, the turbine having an inlet communicating with a nitrogen compressor for compressing said stream of nitrogen.

17. The plant as claimed in claim 16, additionally including heat exchange means connected intermediate to nitrogen compressor and the inlet for pre-heating the stream of nitrogen.

18. The plant as claimed in claim 16 or claim 24, additionally including second expansion turbine having an inlet able to receive nitrogen from upstream of the nitrogen compressor.

19. The plant as claimed in claim 18, additionally including a further heat exchanger for pre-heating nitrogen stream passing to the second expansion turbine.

* * * * *

UNITED STATES PATENT AND TRADEMARK OFFICE

CERTIFICATE OF CORRECTION

PATENT NO. : 5,268,019

DATED : December 7, 1993

INVENTOR(S) : Thomas Rathbone

It is certified that error appears in the above-indentified patent and that said Letters Patent is hereby corrected as shown below:

Column 10, line 42 (claim 18), delete "24" and substitute --17-- therefor.

Signed and Sealed this

Twenty-sixth Day of April, 1994

Bruce Lehman

*Attest:*

BRUCE LEHMAN

*Attesting Officer*

*Commissioner of Patents and Trademarks*